US007121056B2

(12) United States Patent
McKenna

(10) Patent No.: US 7,121,056 B2
(45) Date of Patent: Oct. 17, 2006

(54) HEATED ROOFING SHINGLES HAVING AN IMPROVED ELECTRICAL INTERCONNECTION SYSTEM

(76) Inventor: David J. McKenna, P.O. Box 8031, Breckenridge, CO (US) 80424

( * ) Notice: Subject to any disclaimer, the term of this patent is extended or adjusted under 35 U.S.C. 154(b) by 189 days.

(21) Appl. No.: 10/456,890

(22) Filed: Jun. 9, 2003

(65) Prior Publication Data

US 2004/0244324 A1 Dec. 9, 2004

(51) Int. Cl.
*E04D 1/00* (2006.01)

(52) U.S. Cl. ..... 52/518; 52/522; 52/527

(58) Field of Classification Search ..... 52/745.11, 52/745.21, 543, 52, 522, 518, 527, 520, 173.3; 219/541, 538, 213, 522, 521
See application file for complete search history.

(56) References Cited

U.S. PATENT DOCUMENTS 2,545,743 A 3/1951 Harrison
2,699,484 A 1/1955 Michaels
2,844,696 A * 7/1958 Custer, Jr. ..... 219/213
3,129,316 A 4/1964 Glass et al.
3,691,343 A 9/1972 Norman
3,806,702 A * 4/1974 Spencer ..... 219/528
4,040,867 A * 8/1977 Forestieri et al. ..... 136/244
5,813,184 A 9/1998 McKenna
6,166,352 A * 12/2000 Turton ..... 219/213
6,184,496 B1 * 2/2001 Pearce ..... 219/213
6,348,673 B1 * 2/2002 Winters ..... 219/213

* cited by examiner

*Primary Examiner*—Daniel P. Stodola
*Assistant Examiner*—Nahid Amiri
(74) *Attorney, Agent, or Firm*—Cantor Colburn LLP

(57) ABSTRACT

The present invention features a heated roofing system using standard-size roofing shingles each having a resistive heating element. Each shingle is designed to easily connect to a preassembled, flat electrical power cable having slide-on electrical connectors spaced periodically along its length. The power cable is typically supplied rolled so that as each shingle in a course is attached to a roof, the power cable can be unrolled and each subsequent shingle electrically connected to the cable. A power controller having a temperature sensor and a precipitation sensor controls the flow of electrical energy to the shingles. Because the power cable is flat, it lies well beneath layers of shingles and may be folded at the end of a course so that a single cable may supply power to multiple rows of shingles.

15 Claims, 8 Drawing Sheets

HEATED ROOFING SHINGLES HAVING AN IMPROVED ELECTRICAL INTERCONNECTION SYSTEM

BACKGROUND OF THE INVENTION

1. Related Patents

This patent application is related to my previously issued U.S. Pat. No. 5,813,184 for HEATED SERIALLY CONNECTABLE ROOFING SHINGLES, issued Sep. 29, 1998 which is hereby incorporated by reference.

2. Field of the Invention

The present invention relates to electrically heated roofing shingles. More particularly, the invention provides an improved way for supplying electrical power to electrically heated roofing shingles which facilitate rapid installation and reliable operation of the shingles.

3. Description of the Prior Art

Buildings having pitched roofs and located in areas of high snowfall are susceptible to damage occurring from accumulated snow or other frozen precipitation on their roofs. Thermal expansion and contraction of ice caused by temperature changes may cause physical damage to the roof surface itself or to underlying structural elements. More importantly, however, is the damage caused by infiltration of water resulting from melting of snow and/or ice which backs up under the snow pack on the building roof behind ice dams near the eves of the building.

It is common in northern regions to attempt to abate these problems by installing heating elements such as heating cables or tapes directly on top of the roof. These solutions have, by and large, been only moderately successful. Several heating devices specifically designed for combating the specific problems facing shingled roofs have also been proposed.

One solution is described in U.S. Pat. No. 2,699,484 for DEICER FOR ROOFS, issued Jan. 11, 1955 to H. L. Michaels. MICHAELS teaches a heating devices intended for installation along the lowest edge of a roof. Unlike the roof heating system of the present invention, the MICHAELS system provides heat only along a narrow band near the edge of the roof. These types of solutions are generally considered ineffectual in preventing ice damage and water infiltration. The inventive system, using heated roofing shingles, provides heat for several courses of shingles up the roof which is very effective in preventing problems caused by ice dams near or at the edge of the roof.

Two patents, U.S. Pat. No. 3,691,343 for MODULAR SYSTEM OF ROOF HEATER SHINGLES, issued Sep. 12, 1972 to Victor B. Norman and U.S. Pat. No. 3,129,316 for HEATING ELEMENT FOR ELIMINATING ICE FROM A ROOF, issued Apr. 14, 1964 to F. N. Glass, et al. teach shingle-like heating elements for installation along the lowest edge of a building roof. While these kinds of solutions typically are more effective than that of MICHAELS, in that they heat a larger surface of the roof, they still fall short of the effectiveness of the inventive system. The system of the present invention allows a varying number of courses of heated shingles to be applied, the number of courses being selected based on the environment, the roof pitch, etc.

U.S. Pat. No. 2,546,743 for ELECTRICALLY HEATED DEICING SHINGLE, issued Mar. 27, 1952 to J. L. Harrison teaches a conventional style roofing shingle having an embedded resistance heating element. Each shingle must be individually connected to a power line running above and along the long axis of the course of singles. Installation requires that two electrical connections per shingle be made in situ thus requiring a competent, usually licensed electrician as well as a roofer to complete the installation. Because of the environment, each connection is subject to thermal stress which may result in electrical connection failure during the operating lifetime of the roof. The inventive heated roofing system, on the other hand, utilizes high-reliability, slip-on connectors on each shingle adapted to interact with mating connectors on a pre-assembled, flat power cord. The roofer may then both physically install the shingles and easily and competently make the electrical connections between the shingle and the power line.

Finally, U.S. Pat. No. 5,813,184 for HEATED, SERIALLY CONNECTABLE ROOFING SHINGLES, issued Sep. 29, 1998 to the Applicant, teaches heated roofing shingles having electrical connectors disposed on extended tabs at each edge of the shingles. During installation, the connector on the abutted edges of adjacent shingles readily connect to one another thereby establishing a serial connection across the width of the roof. While the system is easy to install and the electrical connections provided have proven to be reliable, the performance of the roof heating varies as the number of shingles in the serial chain varies. The system of the instant invention overcomes this situation by providing a parallel electrical connection to each shingle. The ease of installation is maintained by providing a pre-assembled, flat power cord having slide-on connectors space periodically along its length offering a connection point for each shingle.

None of the above inventions and patents, taken either singly or in combination, is, however, seen to anticipate or suggest the instant invention as claimed.

SUMMARY OF THE INVENTION

The present invention relates to electrically heated roofing shingles having slide-on electrical connectors adapted to mate with compatible connectors spaced at regular intervals (e.g., 36 inches for standard shingles) along a flat, pre-assembled electrical power cable. Because the power cable is flat, it lies well under the courses of shingles. The system allows rapid installation of the roofing shingles without the assistance of an electrician. The flat cable may be folded over so as to reverse the direction of its run, thereby servicing multiple row (courses) of shingles. The power cable may be supplied in various lengths for use with different width roof installations. The connections made are reliable and the connector components used are typically approved by appropriate agencies such as the Underwrites Laboratory, etc.

Accordingly, it is a principal object of the invention to provide electrically heated roofing shingles having pre-installed, slide-on electrical connectors.

It is another object of the invention to provide an electrically heated roofing shingle system where each shingle plugs into a mating connector on a flat, pre-assemble power cable or cord.

It is a further object of the invention to provide an electrically heated roofing shingle system where the flat, pre-assembled power cable may be folded to change its direction of travel.

Still another object of the invention is to provide an electrically heated roofing shingle system where a single flat, preassembled power cable can provide power to multiple rows of shingles.

An additional object of the invention is to provide an electrically heated roofing shingle system where the flat, pre preassembled power cord is readily connected to a source of electrical power.

It is again an object of the invention to provide an electrically heated roofing shingle system which has a thermostat to control operation of the shingle heating system.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

The present invention relates to a heated roofing system constructed from roofing shingles having built-in electrically powered resistive heating elements. The shingles of the invention are installed in a similar manner to regular roofing shingles but are each connected to a special electrical supply cable.

Figure 1:
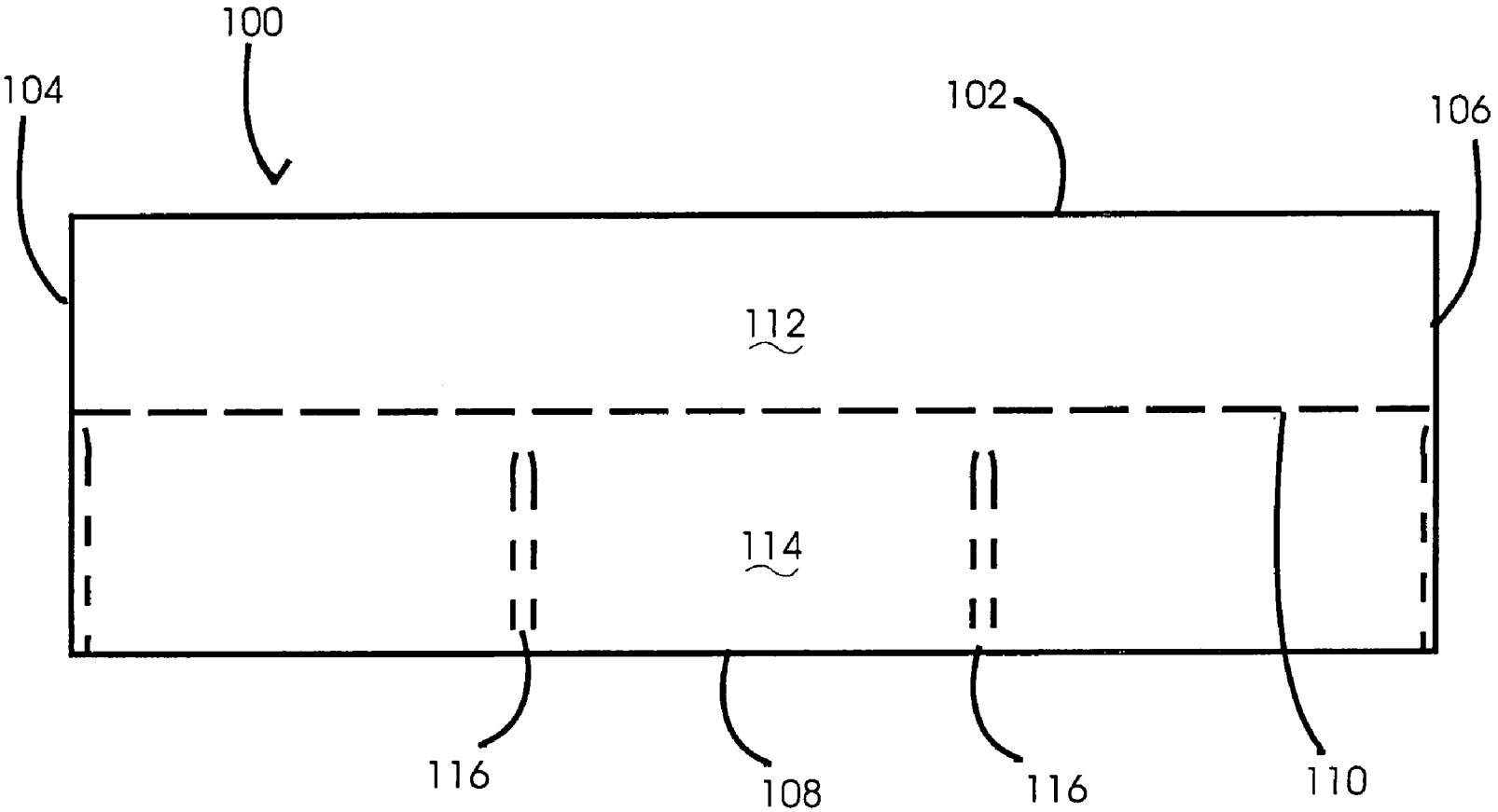
Fig. 1 Prior Art
FIG. 1 is a top plan view of a roofing shingle of the prior art.

Referring first to FIG. 1, there is shown a top plan view of a typical asphalt roofing shingle 100 as is well known in the roofing art. Shingle 100 has a top edge 102, a left edge 104, a right edge 106 and a bottom edge 108. A horizontal centerline 110 separates an upper, unexposed portion 112 of shingle 100 from a lower, exposed portion 114. Typically, lower, exposed portion 114 carries a surface wear treatment (not shown). Optionally, slits 116 may also be provided in a wide variety of configurations also well know to those skilled in the roofing arts. Modern shingles typically omit slits 116.

While asphalt shingles have been chosen for purposes of disclosure, the invention is by no means considered limited to this type of shingle. It will be obvious that the inventive system could be applied to shingles made from wood, metal, tile, slate, or any other material suitable for forming roofing elements. The inventive system could also be applied to roofing elements in form factors other than shingles.

Figure 2:
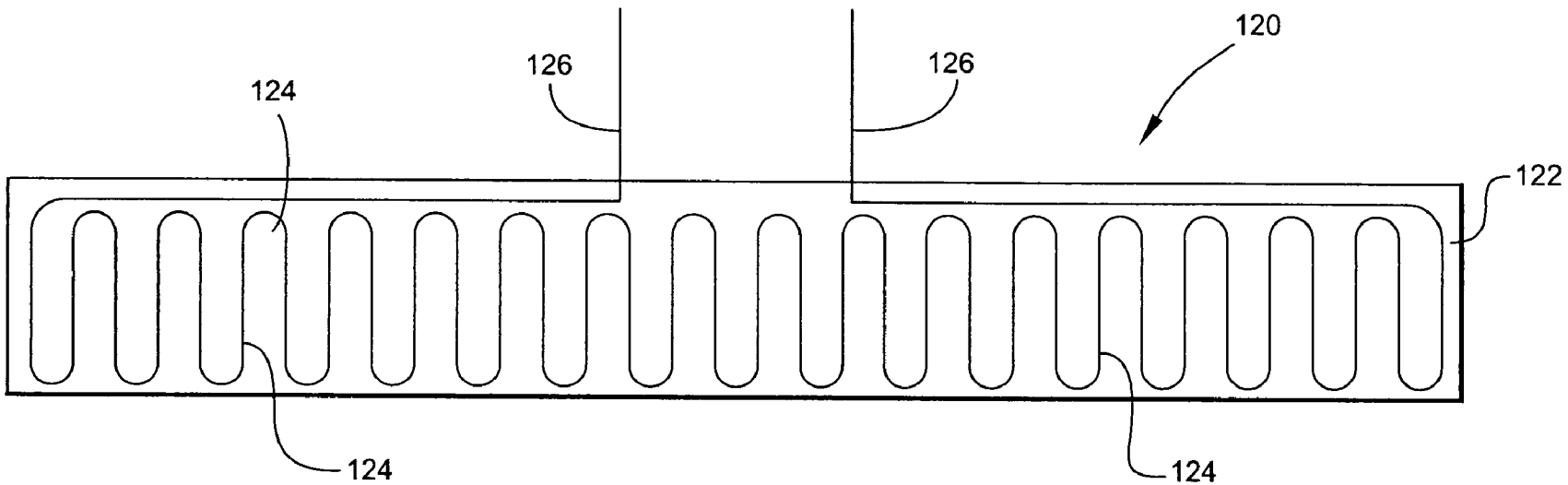
FIG. 2 is a top plan view of the electrically powered resistance heating element of the invention.

Referring now also to FIG. 2, there is shown a top, plan view of a planar heating element 120. A thin substrate 122 has a resistive element 124 disposed on its top surface. Resistive element 124 consists of a continuous electrical conductor having a specific resistance per unit length. Resistance element 124 could be formed by depositing a continuous filament of a small diameter (i.e., high AWG number) conductor made from nickel-chromium or a similar material well known to those skilled in the art. In a preferred embodiment, resistance element 124 is formed using printed circuit fabrication techniques. While a simple serpentine pattern has been shown for purposes of disclosure, it will be obvious that any pattern which provides an appropriate conductor length on substrate 122 could be chosen. The material used for substrate 122 is typically a flexible, heat resistant, polymer. Each end of resistive element 124 terminates in an electrical lead 126. The routing and termination of electrical leads 126 will be described in detail hereinbelow.

Heating element 120 is sized to approximately match the size of lower, exposed region 114 of shingle 100. If shingle 100 carries optional slits 116, resistance heating element 124 could be disposed in a pattern to avoid slits 116.

Figure 3:
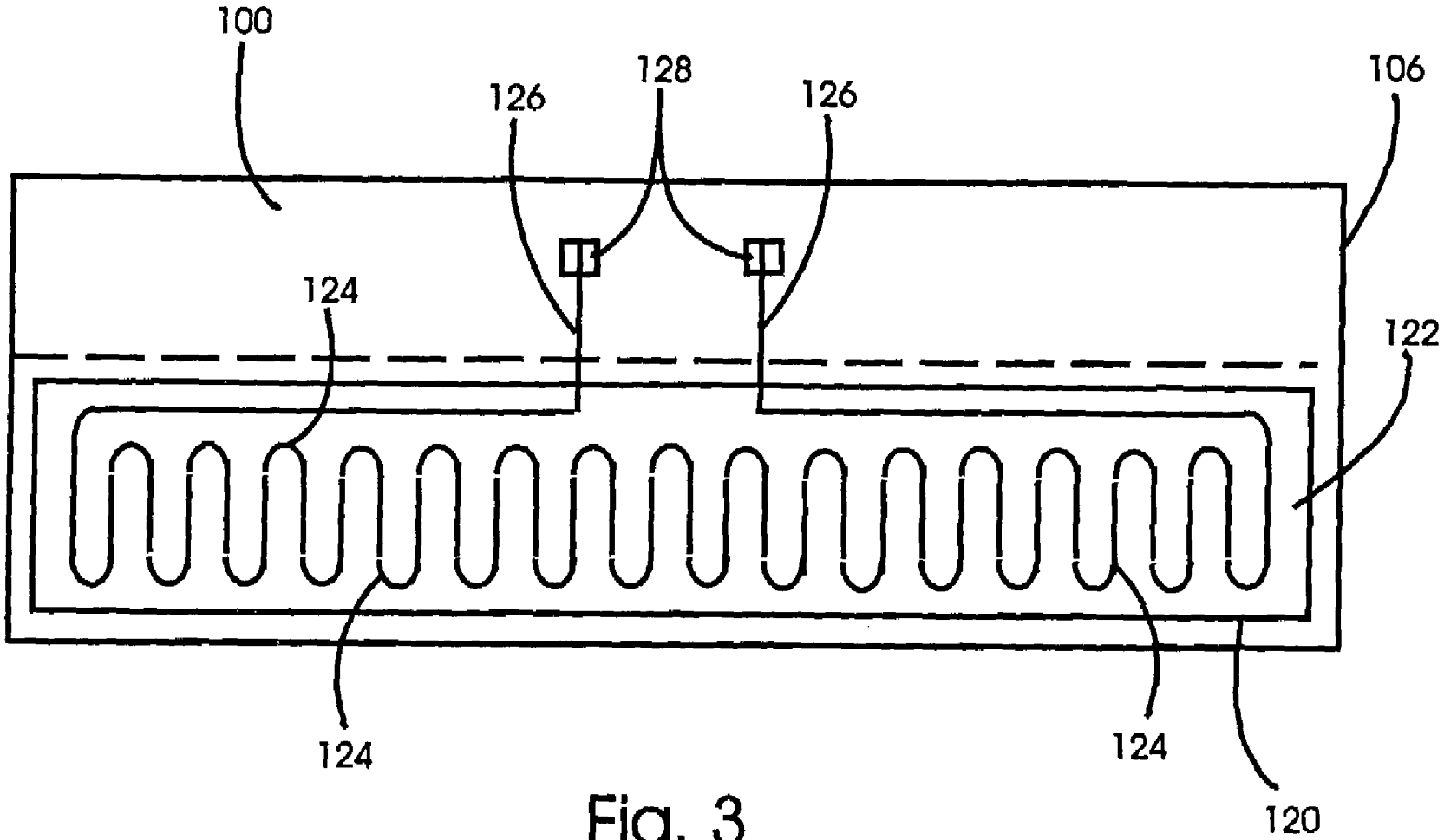
FIG. 3 is a rear plan view of a shingle showing the heating element of FIG. 2 attached to the shingle.

Referring now also to FIG. 3, there is shown a rear plan view of shingle 100 and heating element 120. Heating element 120 is adapted for attachment to the rear surface of shingle 100 directly behind lower, exposed region 114. Heating element 120 may be attached to shingle 100 in a variety of ways. Typically either a thin adhesive or double back tape could be used. A variety of other ways well known to those skilled in the art could also be used to join heating element 120 to shingle 100. Leads 126 connected to resistance element 124 are routed through holes 128 in shingle 120 where they are terminated in slide-on connectors 142 (FIG. 4), typically female. While female connectors on the shingles and male connectors on the power cable have been chosen for purposes of disclosure, it should be obvious that the genders could readily be reversed to meet a particular operating requirement or circumstance. Leads 126 may be restrained against the rear surface of shingle 100 as required. It should be obvious that heating element 124 could easily be made integral with shingle 140. Typically, the heating unit 124 would be sandwiched between a front and a back layer of asphalt or similar shingle base material or imbedded within a layer in the manufacture of the layer. While custom manufacturing would be required, heating unit 124 would probably be better protected during the handling of shingles 140 prior to their installation.

Figure 4:
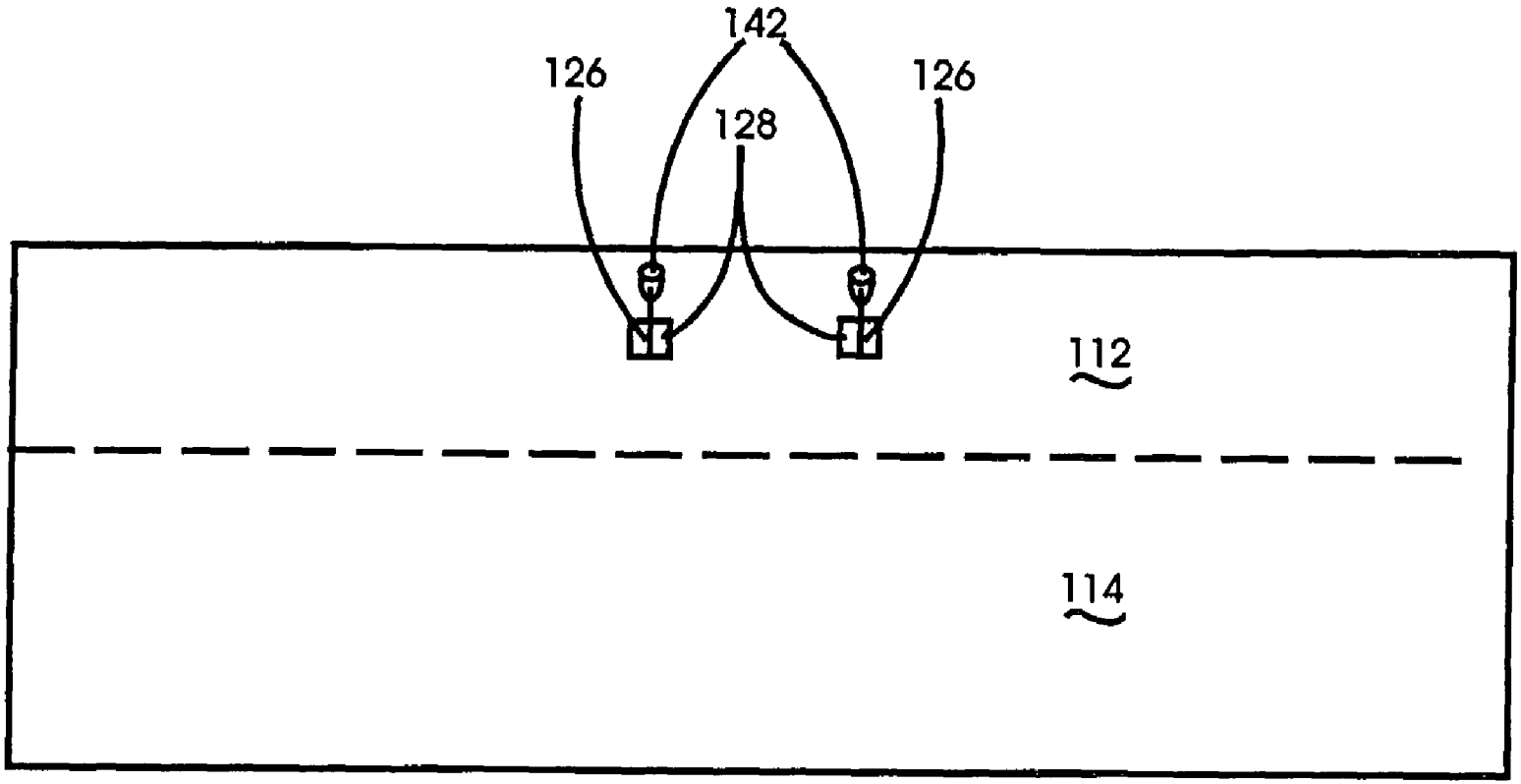
FIG. 4 is a front plan view of the shingle shown in FIG. 3.

Referring now to FIG. 4, there is shown a top, plan view of the shingle 140 of the instant invention. Female slide-on connectors 142 are shown disposed in upper, unexposed region 112 of shingle 140. One connector system found suitable for use in this application is the Pan-Term® series from Panduit®. The male slide-on connector chosen for purposes of disclosure is a Panduit® non-insulated, butted seam male disconnect. Other similar connector systems could, of course, be substituted to meet a particular operating circumstance or environment. Female slide-on connector 142 is adapted to mate with a compatible male connector (not shown) as will be described in detail hereinbelow.

Figure 5:
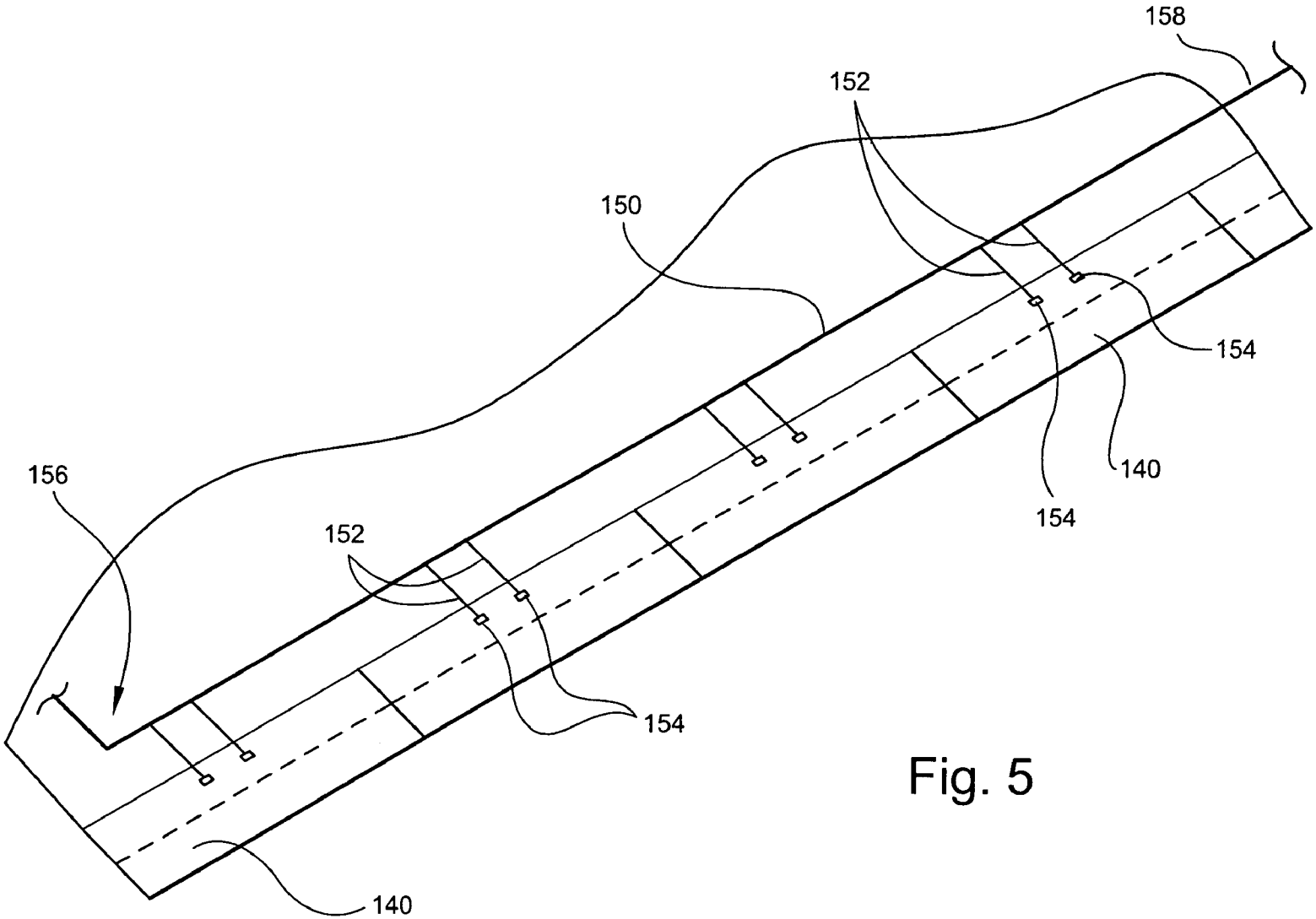
FIG. 5; is an environmental view of a portion of a roof structure showing a first course of shingles installed.
Figure 7:
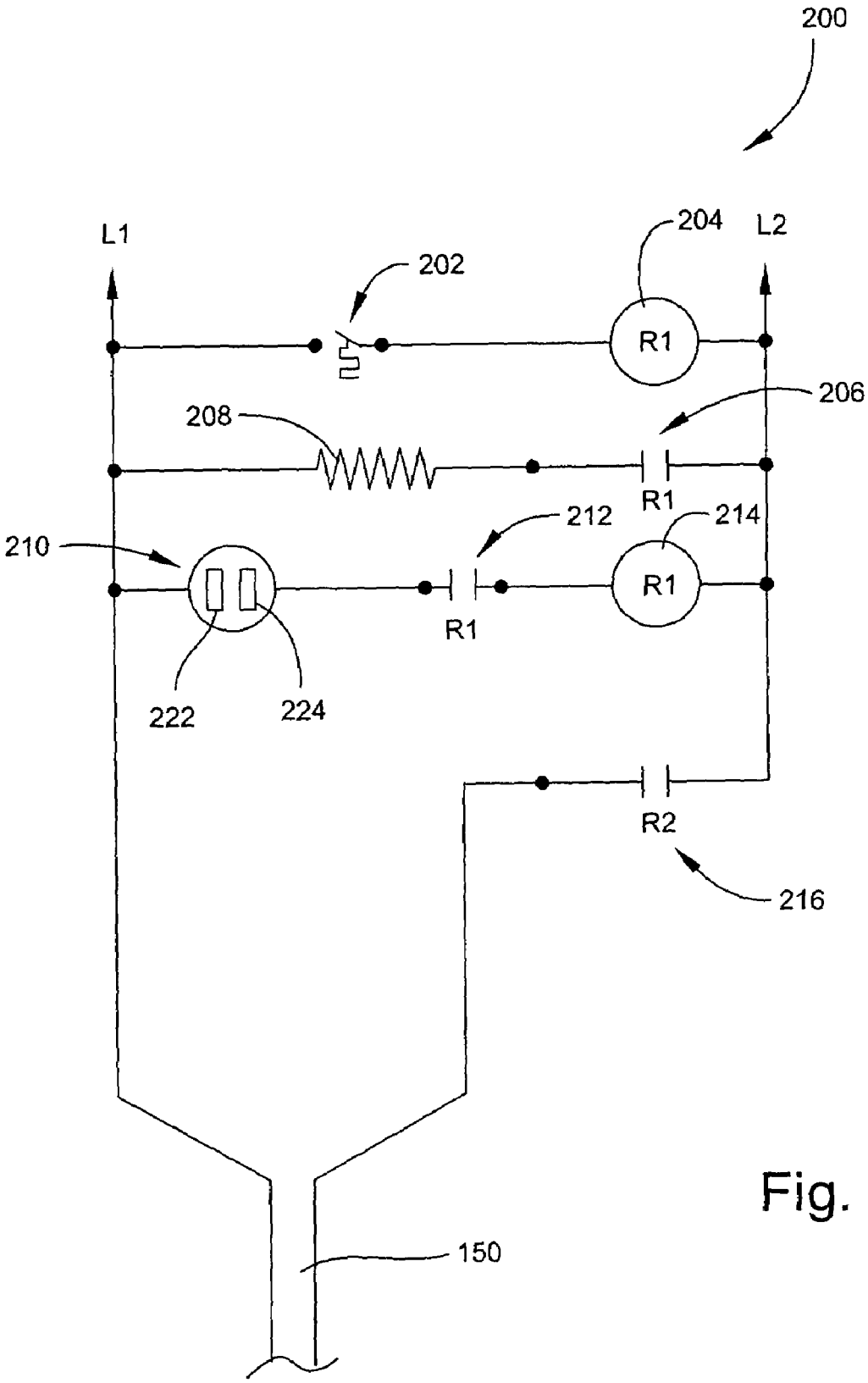
FIG. 7 is a schematic view of a controller suitable for use with the inventive heated shingle system.

Referring now to FIG. 5 there is shown an environmental view showing an array of shingles 140 on a portion of a roof of a building. The inventive heated shingles 140 are designed to work in a system with a uniquely configured power cable 150 as shown in FIG. 5. Shingles 140 are adapted for placement on the roof of a structure in much the same manner as normal roof shingles. Care must, of course, be taken to avoid inadvertently severing resistance element 124 (FIG. 3) or leads 126 (FIG. 3) with a nail, staple or other fastener. Power cable 150 is shown running along and above the course of shingles 140. A distal end 158 of cable 150 is adapted for connection to a source of AC power, usually through a suitable controller 200 (FIG. 7). A suitable plug or interconnection means (not shown) would typically be provided. The plug or interconnection means form no part of the instant invention and suitable plugs or other interconnection means are well know to those skilled in the electrical arts. Electrical drop-down leads or pigtails 152 descend from cable 150 at regular intervals. The interval is chosen to match the width of the shingles being powered, typically 36 inches. It will be obvious that other length shingles could be used and the spacing of pigtails 152 along cable 150 could be adjusted accordingly. Each pigtail 152 terminates in an insulated slide-on connector 154, typically male and adapted to slidably connect to female connectors 142 (FIG. 4) on each shingle 140. Cable 150 is a flat, ribbon-type cable which allows it to be laid along and below courses of shingle without causing an excessive bulge or ridge. This helps not only protect cable 150 but minimizes potential damage to the shingles themself on roofs where people occasionally must walk. The flat construction of cable 150 also allows it to be folded so as to change its direction of travel at a corner 156. This allows a single cable 150 to service more than one course of shingles. When the cable reaches the end of a first course, it is folded, run up (or down) to the next course, folded again and continued in a reversed direction along the next shingle course. Cable 150 is preassembled and typically supplied in a roll. As a course of shingle is fastened to the roof, the cable 150 is unrolled enough to connect each subsequent shingle. This process is continued until the end of the course is reached.

Figure 6:
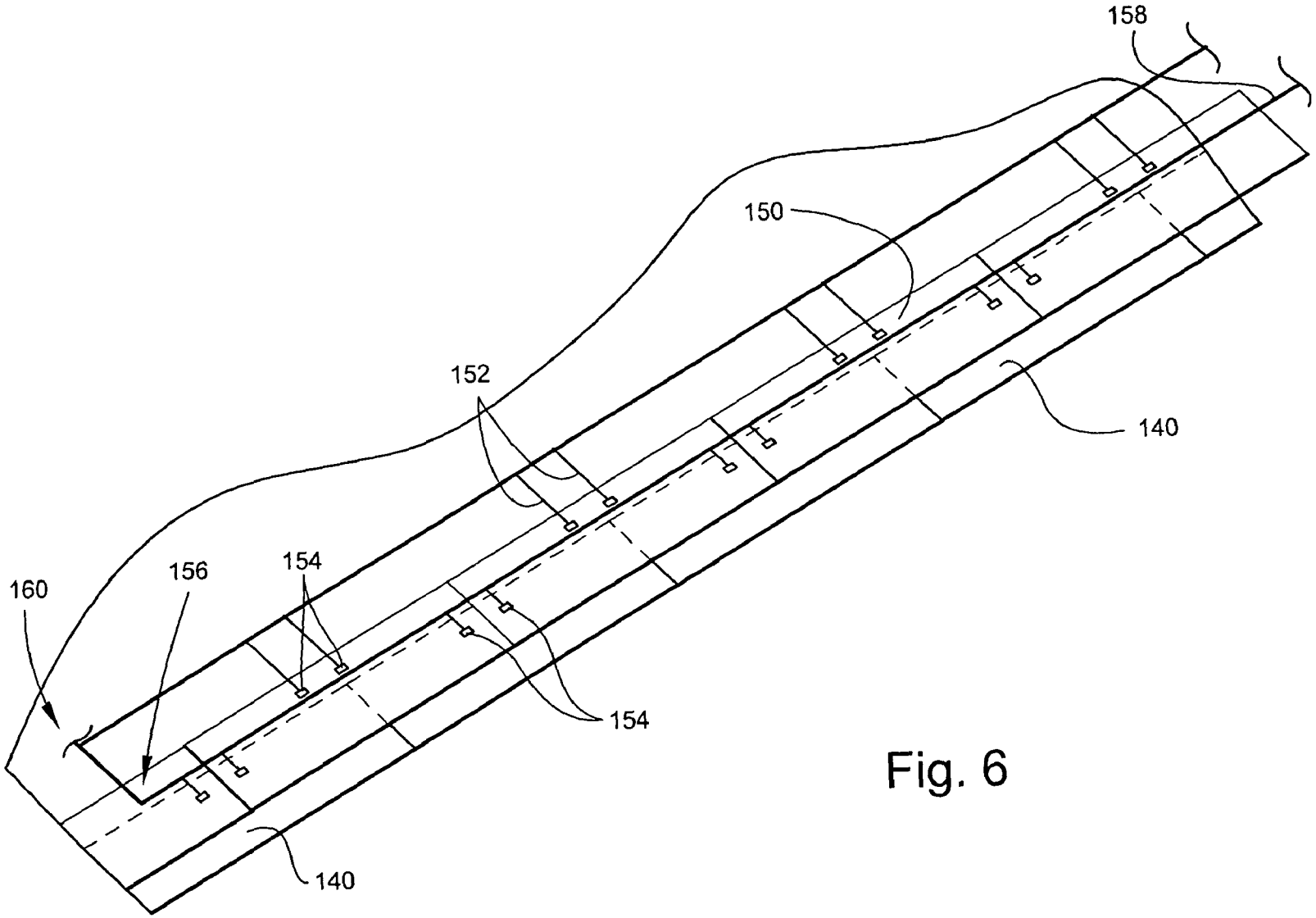
FIG. 6 is an environmental view of the roof portion of FIG. 4 but having a second course of shingles installed.

Referring now to FIG. 6, there is shown the roof segment of FIG. 5 but with a second course of shingles 140 in place. Cable 150 is shown twice folded and connected to shingles 140 of the second course. As is common practice, the second course of shingles overlap the first course of shingles top-to-bottom along a horizontal dividing line 110 (FIG. 1) and are also offset left-to-right approximately one half a shingle width. Cable 150 is folded again at a second corner 160 and, by using pigtails 152 and connectors 154, electrically connecting the shingles 140 of the second course. Additional shingle courses (not shown) could be added, the number required depending upon the typical weather (i.e., temperature, precipitation, etc) and the architectural features of the roof. As many shingle courses as required to prevent ice dams, etc. may be used, two courses being shown only for purposes of disclosure.

Figure 8:
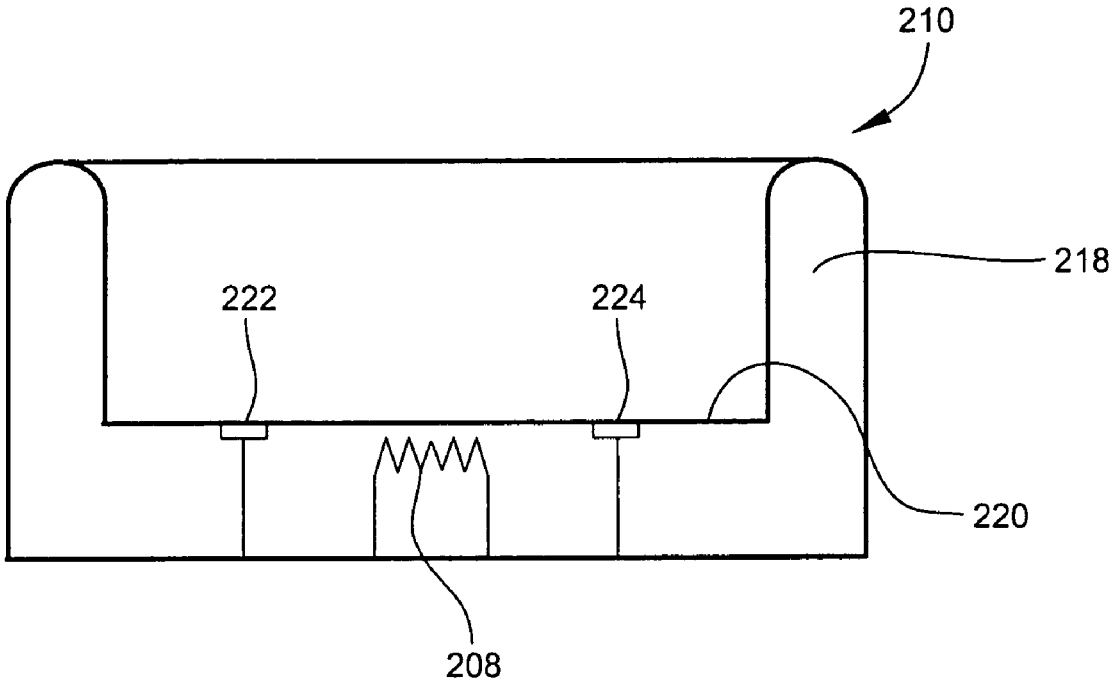
FIG. 8 is a cross-sectional, schematic view of a precipitation sensor for use with the controller of FIG. 7.

It is preferable that the novel roof heating system include a controller. Referring now to FIG. 7, there is shown a schematic diagram of a possible controller 200 suitable for use with the inventive system. AC line power is supplied to controller 200 at terminals labeled L1 and L2. A temperature sensor 202 is located so as to sense outside temperature. When the sensed temperature falls below a predetermined, usually sub-freezing design value, the contacts of temperature sensor 202 close and power is applied to the coil of first relay 204 and first relay 204 is activated. The activation of first relay 204 closes a first normally open contact 206 thereby applying electrical power to a small heating element 208 disposed in a precipitation sensor 210. Referring now also to FIG. 8, there is shown a detailed, cross-sectional view of precipitation sensor 210. Precipitation sensor 210 includes a sampling receptacle 218 open to the atmosphere and fixed to the protected building (not shown) in a position to collect precipitation (not shown). The floor 220 of receptacle 218 contains two electrical terminals 222, 224 and a heating element 208. When precipitation (not shown) is collected within receptacle 218, it is melted by heating element 208. In liquid form, the precipitation spans and connects terminals 222 and 224, thereby completing an electrical circuit. A second relay 214 is connected is series with contacts 222, 224 of precipitation sensor 210 and a second contact of first relay 204 such that if relay 204 has been actuated because the outside temperature is below the predetermined value, precipitation in receptacle 218 is melted by heating element 208. Any significant build-up of liquid from the melted precipitation completes a circuit across contacts 222, 224 and actuated second relay 214. It should be obvious that either second relay 214 must be highly sensitive in order to react to a potentially small current flow or that precipitation sensor 210 must itself be designed to facilitate current flow when melted precipitation is present. Temperature sensors, such as thermal switches, and precipitation sensors are well known to those skilled in the electrical arts and suitable units may readily be selected for use in controller 200. For example, precipitation sensor 210 may operate on principles other than connection of two terminals by melted precipitation. Sensor 210 could, for example, use a capacitance based switch responsive to accumulation of melted precipitation within receptacle 218. Finally, a contact 216 of second relay 214 is closed which allows power to be supplied to cable 150 and, in turn, to heated shingles 140 as has been described in detail hereinabove. In operation, only the combination of both sub-freezing temperatures and the sensing of precipitation causes controller 200 to provide power to the heated shingles 140 via cable 150.

It will be obvious to those skilled in the electrical design arts that numerous other possibilities exist for implementing a control circuit to perform identical or similar functions as controller 200 described for purposes of disclosure. For example, a proportional controller using a thermistor or similar temperature sensing element could be used to provide a varying amount of power to shingles 140 depending on the sensed temperature. A micro-processor based controller could also be used. In a micro-processor based controller, sophisticated algorithms could be embedded in a memory device to allow the controller to be respond to sensed environmental conditions. Additional environmental sensors could also be added in addition to the temperature and precipitation sensors disclosed.

Various connectors may be used to connect controller 200 to the AC power lines and/or to connect flat cable 150 to controller 200. Suitable connectors are also well known to those skilled in the electrical design arts and form no part of the instant invention.

A main power switch (not shown) may be provided to break one or both legs of the AC supply circuit. Breaking both legs is preferable because it provide greater safety. Breaking both legs would, for example, be desirable in electrical supply circuits wherein the voltage of each leg differs in potential with neutral or ground, as commonly occurs in 240 volt, single phase residential circuits. Also, a ground-fault interrupter (GFI) could be included in the power circuit to protect the system from even small leakage current which could potentially pose a threat.

It is to be understood that the present invention is not limited to the embodiments described above, but encompasses any and all embodiments within the scope of the following claims.

What is claimed is:

1. A heated roofing system, comprising:

a) a plurality of shingles each having an upper edge, a lower edge, two side edges, an upper surface, a lower surface, and a predetermined width and comprising an electrically powered resistive heating element, each of said resistive heating elements having a pair of electrical interconnection leads, each terminating in an electrical connector oriented toward and positioned near to said upper edge of said shingle and structured for interconnecting said resistive heating element to a power supply cable near said upper edge of said shingle, said shingles being structured for installation in an abutted, end-to-end arrangement; and b) an elongated, substantially flat power supply cable having a distal end adapted for connection to an electrical power source and having electrical drop-down leads spaced periodically at a distance substantially equal to said predetermined width of said shingles therealong, said electrical drop-down leads comprising pairs of cable electrical connectors capable of removable electrical interconnection with respective pairs of said electrical connectors of said electrical interconnection leads of said plurality of shingles;

whereby electrical power may be applied to each of said resistive heating elements in each of said shingles.

2. The heated roofing system as recited in claim 1, wherein said shingles are deployed in rows, one partially overlying another, thereby creating an overlapped region, and wherein said elongated, substantially flat power supply cable is adapted to run along each of said rows of shingles proximate a top edge of each of said rows of shingles.

3. The heated roofing system as recited in claim 1, wherein said electrically powered resistive heating elements are disposed in a predetermined pattern on at least a rear surface of at least one of said plurality of shingles.

4. The heated roofing system as recited in claim 1, wherein said electrically powered resistive heating elements are disposed in a predetermined pattern on at least a rear surface of substantially all of said plurality of shingles.

5. The heated roofing system as recited in claim 1, wherein said electrical connectors of said electrical interconnection leads of said plurality of shingles comprise female electrical connectors and said cable electrical connectors comprise male electrical connectors and said removable electrical interconnection is accomplished via a slidable electrical interconnection therebetween.

6. The heated roofing system as recited in claim 1, wherein said electrically powered resistive heating element is disposed on the rear surface of said shingle.

7. The heated roofing system as recited in claim 1, wherein said shingles comprise a front layer and a rear layer and wherein said electrically powered resistive heating element is disposed intermediate said front layer and said rear layer.

8. The heated roofing system as recited in claim 1, wherein said electrically powered resistive heating element is imbedded within the thickness of said shingle.

9. The heated roofing system as recited in claim 2, wherein said electrical connectors of said electrical interconnection leads of said plurality of shingles of each of said rows are disposed proximate said top edge of a respective row in which each of said shingles is located.

10. The heated roofing system as recited in claim 9, wherein a predetermined lower portion of said shingles in an upper row overlap a predetermined upper portion of said shingles in a lower row and wherein said elongated, substantially flat power supply cable abuts said top edge of said shingles in said lower row and below said shingles in said upper row proximate said overlapped region.

11. The heated roofing system as recited in claim 5, wherein said elongated, substantially flat power supply cable is adapted to be folded and may be disposed in a serpentine fashion thereby supplying electrical power successively to shingles disposed in at least two adjacent rows, running proximate a top edge of a first row of shingles in a first direction, changing direction and running proximate a top edge of a second row of shingles in an opposite direction.

12. The heated roofing system as recited in claim 5, further comprising:

control means adapted for selective application of power to said distal end of said elongated, substantially flat power supply cable, said control means comprising temperature sensing means configured to apply electrical power to said plurality of shingles when a sensed temperature falls below a predetermined temperature.

13. The heated roofing system as recited in claim 12, wherein said predetermined temperature comprises a subfreezing temperature.

14. The heated roofing system as recited in claim 12, wherein said control means further comprises a precipitation sensor operatively connected to said temperature sensing means and adapted to apply power to said shingles only when a predetermined amount of precipitation has been sensed and said sensed temperature is below said predetermined temperature.

15. A heated roofing system, comprising:

a) a plurality of shingles each having an upper edge, a lower edge, two side edges, an upper surface, a lower surface, a predetermined width and comprising an electrically powered resistive heating element affixed to said lower surface thereof, each of said resistive heating elements having a pair of electrical interconnection leads, each terminating in an electrical connector oriented toward and positioned near to said upper edge of said shingle and structured for interconnecting said resistive heating element to a power supply cable;

b) an elongated, substantially flat power supply cable having a distal end adapted for connection to an electrical power source and having electrical drop-down leads spaced periodically at a distance substantially equal to said predetermined width of said shingles therealong, said electrical drop-down leads comprising pairs of electrical connectors adapted for removable electrical interconnection with respective pairs of said electrical connectors of said electrical interconnection leads of said plurality of shingles;

c) control means adapted for selective application of power to said distal end of said elongated, substantially flat power supply cable, said control means comprising temperature sensing means configured to apply electrical power to said plurality of shingles when a sensed temperature falls below a predetermined temperature; and d) a precipitation sensor operatively connected to said temperature sensing means and adapted to apply power to said shingles only when a predetermined amount of precipitation has been sensed and said sensed temperature is below said predetermined temperature;

whereby electrical power may be applied to each of said resistive heating elements in said shingles.

* * * * *